United States Patent [19]

Thuries et al.

[11] Patent Number: 4,940,961

[45] Date of Patent: Jul. 10, 1990

[54] BRAKING RESISTOR FOR A HIGH TENSION ELECTRICAL NETWORK

[75] Inventors: Edmond Thuries; Van Doan Pham, both of Meyzieu; Roger Ledru, Pont De Cheruy, all of France

[73] Assignee: Societe Anonyme dite : Alsthom, Paris, France

[21] Appl. No.: 292,162

[22] Filed: Dec. 30, 1988

[30] Foreign Application Priority Data

Dec. 30, 1987 [FR] France ..... 87 18412

[51] Int. Cl.[5] ..... H01C 7/10

[52] U.S. Cl. ..... 338/21; 361/117; 338/20

[58] Field of Search ..... 338/20, 21; 361/116, 361/117, 118, 120, 121, 127, 128, 129

[56] References Cited

U.S. PATENT DOCUMENTS

| | | | |
|---|---|---|---|
| 2,276,732 | 3/1942 | Ludwig et al. | 338/21 |
| 3,096,496 | 7/1963 | Burrage | 338/21 |
| 3,227,983 | 1/1966 | Braun | 338/21 |
| 3,896,352 | 7/1975 | Miles | 361/128 |
| 3,968,393 | 7/1976 | Murano et al. | 361/129 X |
| 4,638,285 | 1/1987 | Lott | 338/21 |

FOREIGN PATENT DOCUMENTS 858117 7/1957 United Kingdom .

*Primary Examiner*—George H. Miller, Jr.
*Assistant Examiner*—Marvin M. Lateef
*Attorney, Agent, or Firm*—Sughrue, Mion, Zinn, Macpeak & Seas

[57] ABSTRACT

A braking resistance having at least one basic element (400) including a ceramic envelope (1) receiving at least one stack of conducting solid disks (11) made of a carbon-based ceramic and having a resistivity lying in the range 100Ω.cm to 1000Ω.cm. A tube (20) maintains the stack. A spring (14) exerts pressure on the stack of disks. Electrical contact is provided between each end of each stack and respective conducting plates located at the ends of the envelope and the envelope is filled with nitrogen at a pressure of 1 to 2 bars.

9 Claims, 2 Drawing Sheets

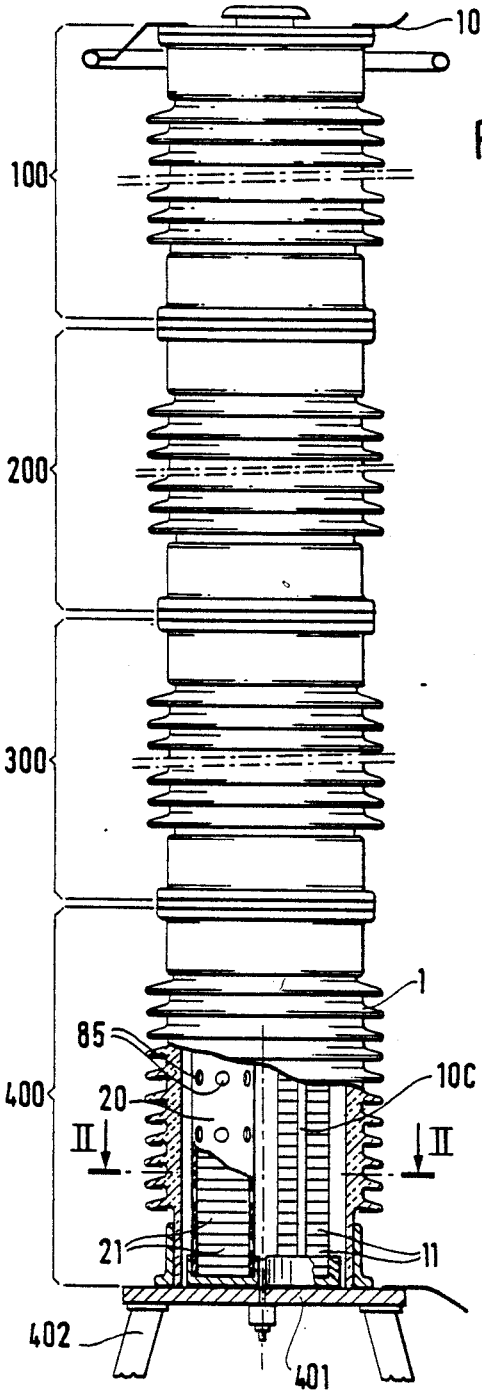
FIG.1
FIG.2
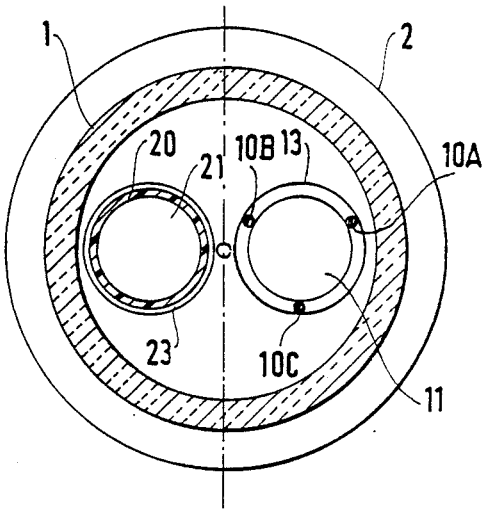

BRAKING RESISTOR FOR A HIGH TENSION ELECTRICAL NETWORK

The present invention relates to a braking resistor.

BACKGROUND OF THE INVENTION

The term "braking resistor" is used to designate an element exhibiting electrical resistance and intended for insertion in a high tension or in a very high tension network in order to avoid the voltage surges that may arise during loss of load or of synchronization due to one or more circuit breakers opening. Such a resistor must be capable of being connected in circuit for a period of about 1 second and it must be capable of dissipating several hundred megajoules of energy.

A load resistor has been made in the United States by means of a sheet of metal wires (nickel chrome) of very great length suspended between two pylons.

This embodiment is expensive by virtue of the large area of ground required for receiving the pylons; in addition, the wires lengthen in operation and the wind can then cause them to tangle, thereby setting up undesirable short circuits.

Proposals have been made to constitute a braking resistor in the same way as a resistor for connecting neutral to ground, by means of a stack of carbon-based ceramic disks received in a metal container.

This solution is expensive and requires sulfur hexafluoride insulation in order to reduce the dimensions of the metal container.

An object of the invention is to provide a braking resistor of reduced cost price.

SUMMARY OF THE INVENTION

The present invention provides a braking resistor comprising:

at least one basic element comprising a ceramic envelope receiving at least one stack of conducting solid disks made of a carbon-based ceramic and having resistivity lying in the range 100 Ω.cm to 1000 Ω.cm;

means for maintaining said stack;

means for exerting pressure on the stack of disks; and means for providing electrical contact between the ends of each stack and respective conducting plates located at the ends of the envelope, said envelope being filled with nitrogen at a pressure of 1 to 2 bars.

The resistor comprises 2 to 4 basic elements which are superposed coaxially, which are electrically connected in series, and which constitute a column.

Each basic element comprises 1 to 3 stacks disposed side-by-side and electrically connected in parallel.

BRIEF DESCRIPTION OF THE DRAWINGS

An embodiment of the invention is described by way of example with reference to the accompanying drawings, in which:

FIG. 1 is an elevation view of a resistor including four basic elements in accordance with the invention;

FIG. 2 is a section view on line II—II of FIG. 1; and

MORE DETAILED DESCRIPTION

Figure 3:
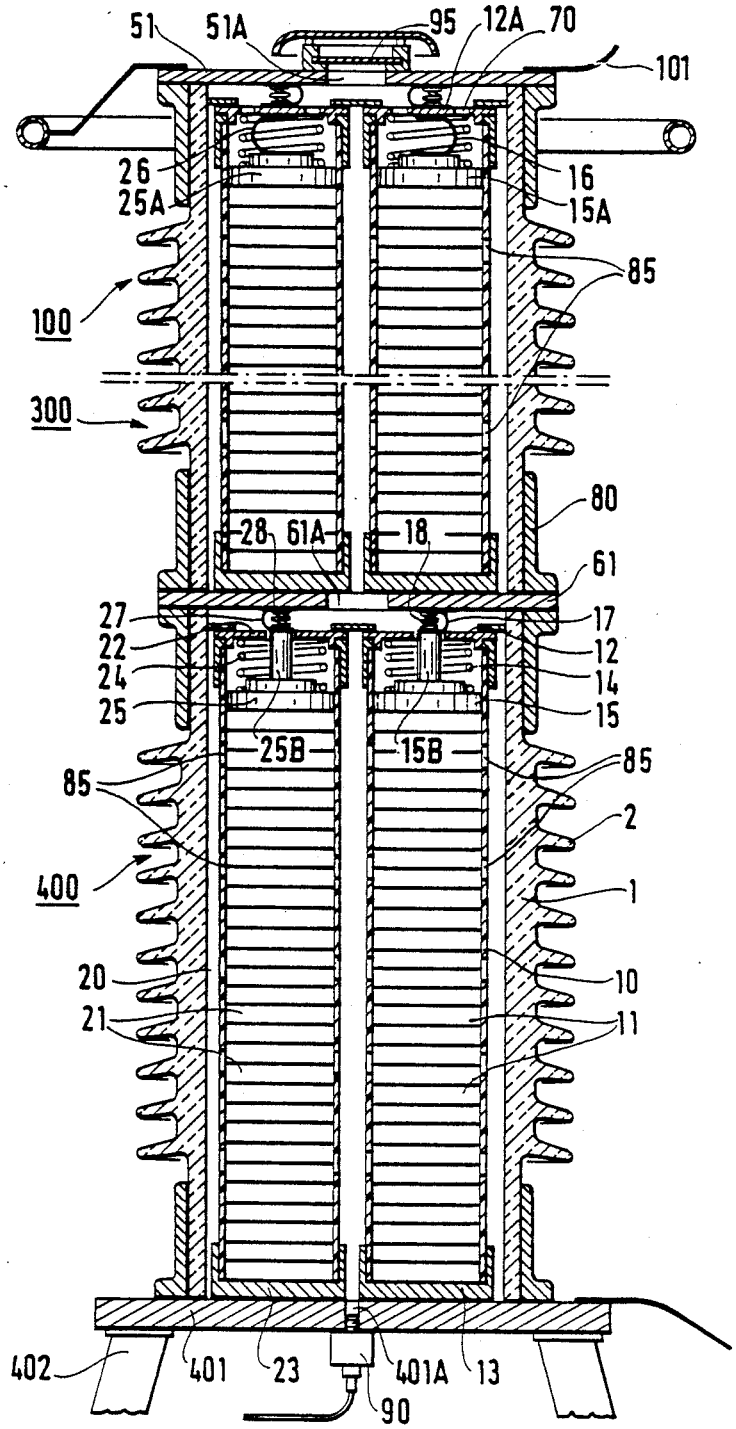
FIG. 3 is a fragmentary view on a larger scale and in section through the resistance of FIG. 1.

The figures show an example of a 250 MW resistor made in accordance with the invention for use on one phase of a 735 kV line.

In FIG. 1, it can be seen that the resistance comprises four basic elements referenced 100, 200, 300, and 400 which are superposed coaxially and assembled to one another.

The bottom element 400 is placed on a stand including a metal plate 401 connected to ground and a plurality of metal legs 402.

The top element is connected via a connection 101 to one of the phase conductors of a circuit breaker (not shown).

The top element 100 is also provided with an equipotential ring 102 which is electrically connected to the potential of the phase.

Each basic element comprises a ceramic envelope 1 having fins 2. The envelope is filled with nitrogen at a pressure of a few bars (a typical filling pressure being 2 bars).

Two thin-walled tubes 10 and 20, preferably made of epoxy glass are disposed inside the envelope.

Each tube is filled with a stack of carbon-based conducting ceramic disks 11, 21.

In the example shown, the disks are solid, i.e. they do not have a central hole, and their diameter is about 13 cm, their thickness is about 25 mm, and each has a resistance of 12.5 ohms (i.e. a resistivity of 650 Ω.cm).

The tubes 10 and 20 are closed at their tops by respective metal lids 12 and 22 which may be screwed onto the corresponding tubes, for example.

The bottoms of the tubes are closed by respective metal plugs 13 and 23 which are glued or screwed to the tube.

The disks in each stack are pressed against one another by a respective spring 14 or 24 extending between the corresponding lid 12 or 22 and a metal plate 15 or 25 providing electrical continuity with the disks.

In a variant, shown at the top of FIG. 3, the plate 15A or 25A serves only as a bearing surface for the spring with currents being transmitted partially by the spring itself and mainly by a metal braid 16 or 26.

Each end of a column is closed by an airtight closure plate made of a conducting metal for passing current.

Thus, in FIG. 3, there is a plate 51 closing basic element 100 and connected to the phase conductor by the link 101; there is also a plate 61 interconnecting elements 300 and 400 and there is the plate 401 described above with reference to FIG. 1.

Mechanical connections between the end plates and the basic elements are provided by collars such as 80. The electrical connections between the centering pieces 15B and 25B and the top terminal plates 51 and 61 are provided by means of metal strips such as 17 and 27 and springs such as 18 and 28.

The terminal plates have orifices 401A, 61A, and 51A to enable nitrogen to flow between the envelopes. Similarly, the lids 12 and 27 have orifices 70 for improving pressure equilibrium between the inside and the outside of each tube. In order to convey heat from the inside of a tube to the outside thereof, the tube may have orifices or openings such as 85.

In a variant, each tube is replaced by a plurality of parallel insulating rods forming a cage around the stack of disks, e.g. three rods as shown in FIG. 2 where the rods are referenced 10A, 10B, and 10C.

The orifice 401A is associated with a valve 90 communicating with a supply of nitrogen (not shown). The top of the orifice 51A is covered by a breakage disk 95.

In the example shown in the figure, each tube contains 85 disks, giving it a height of about 2.15 meters (m).

Each envelope is thus nearly 2.3 m high and the entire resistor including all four basic elements and its stand has a total height of about 12 meters.

The ground area occupied is very small since the outside diameter of the fins in a column is about 60 cm.

Internal electrical insulation is provided by the low pressure nitrogen extending over the great length of the resistor tube which ensure that the voltage gradient is no more than 500 V/cm.

The energy absorbed in one second is about 370 joules/cm$^3$ of disks material. The operating cycle of the circuit breaker in series with the brake resistor is: closed; 1 second; open.

The chosen disposition has very low self-inductance (a vertical rectilinear disposition using disks that exhibit resistance without any self-inductance), so that cos $\phi$ is close to 1, which avoids disturbing the network.

Assembly is extremely easy.

For a power of 1000 MW at a line voltage of 735 kV, each phase would have three columns connected in parallel, each column would have four basic elements connected in series and each basic element would include three tubes of 85 disks each.

These examples are merely by way of illustration. For any given case, the person skilled in the art is capable of choosing, for each phase, the appropriate number of columns to be connected in parallel, the appropriate number of basic elements to be connected in series in each column, the appropriate number of tubes within each basic element, and the appropriate dimensions for each disk.

In general, a maximum of three columns each containing a maximum of four basic elements each containing a maximum of three tubes with a maximum of 100 disks per tube will suffice, with the resistivity of each disk lying in the range 100 Ω.cm to 1000 Ω.cm.

We claim:

1. A braking resistor comprising:

at least one basic element comprising a ceramic envelope receiving at least one stack of conducting solid disks made of a carbon-based ceramic and having resistivity lying in the range 100 Ω.cm to 1000 Ω.cm;

means for maintaining said stack;

means for exerting pressure on the stack of disks; and means for providing electrical contact between the ends of each stack and respective conducting plates located at the ends of the envelope, the improvement wherein said envelope is filled with nitrogen at a pressure of 1 to 2 bars, said means for holding or maintaining stack is a tube of epoxy glass with the disks being placed inside the tube, and said tube including a plurality of orifices through a tube wall for enhancing nitrogen flow about said stack of conducting solid disks whereby heat is dissipated and internal electrical insulation is enhanced by the pressure of low pressure nitrogen extending over the length of the resistor tube thereby providing a voltage gradient no greater than 500 V/cm with energy absorption by the braking resistor in one second on the order of 370 joules/cm, and wherein the braking resistor has a very low self-inductance.

2. A resistor according to claim 1, comprising two to four basic elements which are superposed in coaxial manner, which are electrically connected in series, and which constitute a column.

3. A resistor according to claim 2, comprising a plurality of columns electrically connected in parallel.

4. A resistor according to claim 1, characterized in that each basic element comprises one to three stacks disposed side-by-side and electrically connected in parallel.

5. A resistor according to claim 1, in which said tube is closed at its top end by a lid having a spring bearing thereagainst and against a conducting plate associated with a centering piece, thereby ensuring contact pressure between the disks.

6. A resistor according to claim 6, wherein the centering piece is associated with a metal strip in order to provide electrical continuity.

7. A resistor according to claim 6, in which said plate and said lid are electrically interconnected by a braid.

8. A resistor according to claim 1, in which the bottom of each tube is closed by a metal bottom member.

9. A resistor according to claim 1, wherein pairs of basic elements are interconnected by a metal plate ensuring that the envelopes are airtight and providing electrical conduction between said basic elements.

* * * * *